US008568948B2

(12) United States Patent
Fujiwara et al.

(10) Patent No.: US 8,568,948 B2
(45) Date of Patent: Oct. 29, 2013

(54) ELECTROSTATIC-IMAGE-DEVELOPING TONER, ELECTROSTATIC IMAGE DEVELOPER, METHOD OF MANUFACTURING ELECTROSTATIC-IMAGE-DEVELOPING TONER, TONER CARTRIDGE, PROCESS CARTRIDGE, METHOD OF IMAGE FORMATION, AND IMAGE FORMING APPARATUS

(75) Inventors: Yoshimasa Fujiwara, Kanagawa (JP); Masaaki Suwabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 669 days.

(21) Appl. No.: 12/695,744

(22) Filed: Jan. 28, 2010

(65) Prior Publication Data

US 2011/0045395 A1 Feb. 24, 2011

(30) Foreign Application Priority Data

Aug. 21, 2009 (JP) ..... 2009-192165

(51) Int. Cl.
*G03G 9/00* (2006.01)

(52) U.S. Cl.
USPC ..... 430/108.1; 430/108.8; 430/110.1; 430/111.35

(58) Field of Classification Search
USPC ..... 430/108.1, 108.8, 110.1, 111.35
See application file for complete search history.

(56) References Cited

U.S. PATENT DOCUMENTS

| | | | | |
|---|---|---|---|---|
| 5,244,765 | A * | 9/1993 | Katoh et al. | 430/108.8 |
| 6,132,919 | A | 10/2000 | Ogawa et al. | |
| 2002/0081510 | A1 | 6/2002 | Sugiyama et al. | |
| 2004/0048183 | A1 * | 3/2004 | Teshima | 430/137.1 |
| 2004/0076899 | A1 | 4/2004 | Sugiyama et al. | |
| 2004/0137356 | A1 | 7/2004 | Tomita et al. | |
| 2005/0058923 | A1 * | 3/2005 | Fujii et al. | 430/108.4 |
| 2005/0175923 | A1 | 8/2005 | Nakazawa et al. | |
| 2005/0233238 | A1 | 10/2005 | Eida et al. | |
| 2006/0210903 | A1 * | 9/2006 | Ohki et al. | 430/109.4 |
| 2006/0292474 | A1 | 12/2006 | Mikuriya et al. | |
| 2007/0117035 | A1 | 5/2007 | Suwabe et al. | |
| 2007/0134577 | A1 * | 6/2007 | Tong et al. | 430/108.1 |
| 2007/0218385 | A1 | 9/2007 | Kojima et al. | |
| 2007/0254224 | A1 | 11/2007 | Sugino | |
| 2007/0299191 | A1 | 12/2007 | Lobo et al. | |
| 2008/0029924 | A1 | 2/2008 | Maezawa et al. | |

FOREIGN PATENT DOCUMENTS

| | | | |
|---|---|---|---|
| CN | 1652033 | A | 8/2005 |
| CN | 1684005 | A | 10/2005 |
| CN | 1971432 | A | 5/2007 |
| CN | 101038452 | A | 9/2007 |
| CN | 101063834 | A | 10/2007 |
| CN | 101118393 | A | 2/2008 |
| JP | A-5-11501 | | 1/1993 |
| JP | A-11-2922 | | 1/1999 |
| JP | A-2000-66445 | | 3/2000 |
| JP | A-2001-337485 | | 12/2001 |
| JP | A-2003-131430 | | 5/2003 |

OTHER PUBLICATIONS

Sep. 20, 2012 Office Action in Chinese Application No. 201010120363.0 (with English translation).

* cited by examiner

*Primary Examiner* — Thorl Chea
(74) *Attorney, Agent, or Firm* — Oliff & Berridge, PLC

(57) ABSTRACT

An electrostatic image developing toner includes toner particles that contain a binding resin, a coloring agent and a release agent and that have D50 of from about 2.0 μm to about 8.0 μm, D50 standing for a volume-average particle size of the toner particles; and non-colored release agent particles, wherein out of the non-colored release agent particles, those ranging in volume-average particle size of from about 0.8 to about 1.2 times a value of D50 are present in a proportion of about 50 or below per 5,000 of the toner particles.

13 Claims, 1 Drawing Sheet

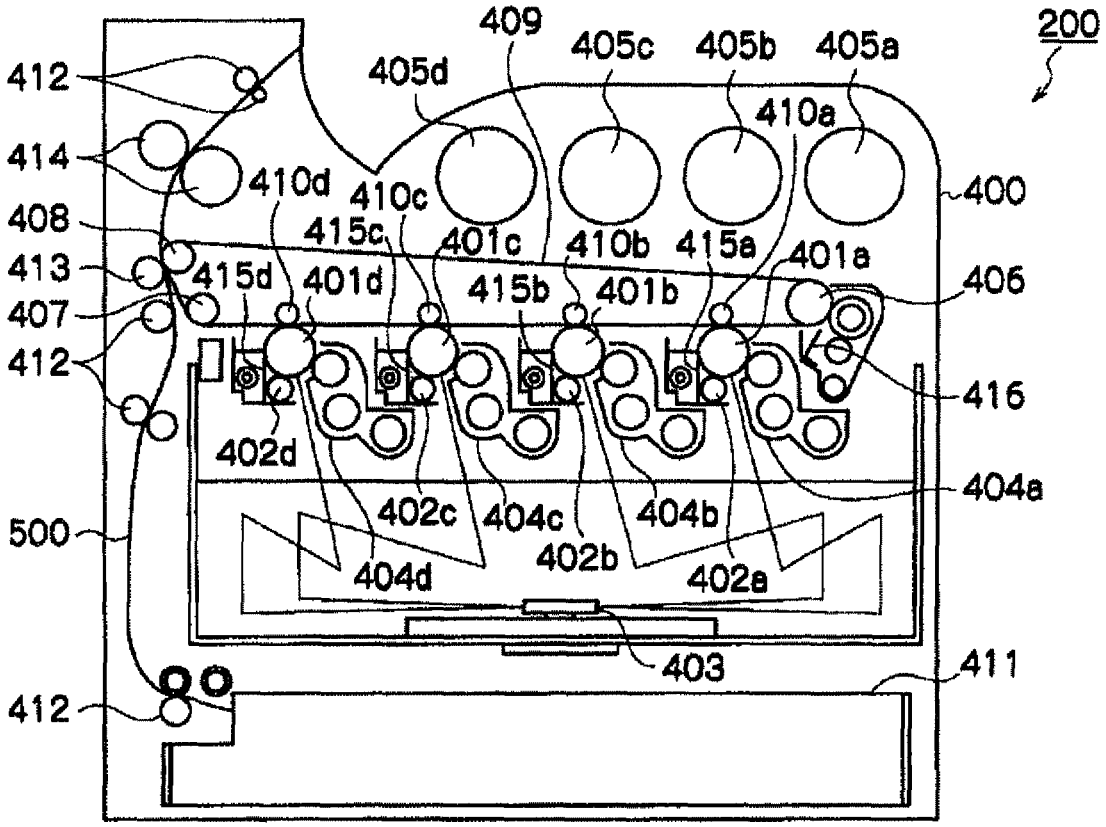
200
409
405c
405b
405a
412
405d
410a
414
410d
410c
400
408
415c
401c
410b
415a
401a
413
415d
401d
415b
401b
406
407
412
416
402d
404a
402c
404c
404b
500
402b
404d
402a
403
411
412

ELECTROSTATIC-IMAGE-DEVELOPING TONER, ELECTROSTATIC IMAGE DEVELOPER, METHOD OF MANUFACTURING ELECTROSTATIC-IMAGE-DEVELOPING TONER, TONER CARTRIDGE, PROCESS CARTRIDGE, METHOD OF IMAGE FORMATION, AND IMAGE FORMING APPARATUS

CROSS-REFERENCE TO RELATED APPLICATIONS

This application is based on and claims priority under 35 USC 119 from Japanese Patent Application No. 2009-192165 filed on Aug. 21, 2009.

BACKGROUND

1. Technical Field

The present invention relates to electrostatic-image-developing toner, an electrostatic image developer, a method of manufacturing electrostatic-image-developing toner, a toner cartridge, a process cartridge, a method of image formation, and image forming apparatus.

2. Related Art

Methods for visualizing image information via electrostatic latent images, including electrophotographic methods, are now going into wide use. In the electrophotographic methods, electrostatic latent images on the surface of an electrophotographic photoreceptor (or an electrostatic latent-image holding member, hereinafter abbreviated as "a photoreceptor" in some cases) are developed with electrostatic-image-developing toner (hereinafter simply referred to as "toner" too) after they undergo a charging process, a light exposure process and so on, and further subjected to a transfer process, a fixing process and so on, whereby the electrostatic latent images are visualized.

As methods of manufacturing toner, a kneading-and-pulverization method, an emulsion-polymerization-and-aggregation method and so on are known. The toner obtained by the former kneading-and-pulverization method is relatively broad in size distribution of particles and irregular in shape, so it is insufficient in performance retaining properties.

In contrast to the former method, the emulsion-polymerization-and-aggregation method is a method of manufacturing toner by forming aggregate particles equivalent in size to toner particles, and then by heating the aggregate particles to fuse and coalesce them. Further, this method allows free control from an internal layer to a surface layer in toner, thereby ensuring more precise control of particle structure.

SUMMARY

According to an aspect of the invention, there is provided an electrostatic image developing toner including: toner particles that contain a binding resin, a coloring agent and a release agent and that have D50 of from about 2.0 μm to about 8.0 μm, D50 standing for a volume-average particle size of the toner particles; and non-colored release agent particles, wherein out of the non-colored release agent particles, those ranging in volume-average particle size of from about 0.8 to about 1.2 times a value of D50 are present in a proportion of about 50 or below per 5,000 of the toner particles.

BRIEF DESCRIPTION OF THE DRAWINGS

Exemplary embodiment(s) of the present invention will be described in detail based on the following FIGURES, wherein:

FIG. 1 is a schematic diagram showing an example of the configuration of image forming apparatus used in image formation according to the invention, wherein

200 denotes Image forming apparatus, 400 denotes Housing, 401*a* to 401*d* denote Electrophotographic photoreceptors, 402*a* to 402*d* denote Charging rolls, 403 denotes Exposure unit, 404*a* to 404*d* denote Developing units, 405*a* to 405*d* denote Toner cartridges, 406 denotes Driving roll, 407 denotes Tension roll, 408 denotes Backup roll, 409 denotes Intermediate transfer belt, 410*a* to 410*d* denote Primary transfer rolls, 411 denotes Tray (transfer-receiving-medium tray), 412 denotes Transporting roll, 413 denotes Secondary transfer roll, 414 denotes Fixing roll, 415*a* to 415*d* and 416 denote Cleaning blades, and 500 denotes Transfer receiving medium.

DETAILED DESCRIPTION

An electrostatic-image-developing toner, an electrostatic image developer, a method of manufacturing an electrostatic-image-developing toner, a method of image formation and image forming apparatus, which are exemplary embodiments of the invention, are illustrated below.

<Electrostatic-Image-Developing Toner and its Manufacturing>

The electrostatic-image-developing toner (hereinafter referred simply to as toner too), an exemplary embodiment of the invention, is toner which includes toner particles that contain a binding resin, a coloring agent and a release agent and that have a D50 of from 2.0 μm to 8.0 μm or from about 2.0 μm to about 8.0 μm, D50 standing for a volume-average particle size of the toner particles; and non-colored release agent particles, wherein out of the non-colored release agent particles, those ranging in volume-average particle size of from 0.8 to 1.2 times or from about 0.8 to about 1.2 times a value of D50 are present in a proportion of 50 or below, or about 50 or below per 5,000 of the toner particles.

In the case of preparing a dispersion liquid of release agent which is used in the emulsion-polymerization-and-aggregation method described hereafter, the dispersion liquid of release agent can be obtained by heating a mixed solution containing a mixture of e.g. the release agent and a dispersant at a temperature equal to or higher than the melting temperature of the release agent, then emulsifying the mixed solution by use of a high-pressure emulsion machine, and further solidifying the release agent particles by cooling.

However, there is a case where particles of large sizes which cannot be used in the emulsion-polymerization-and-aggregation method for toner manufacturing are present in the dispersion liquid of release agent particles obtained in the foregoing manner. More specifically, while the sizes of release agent particles used in toner manufacturing range from 150 nm to 250 nm in ordinary cases, there is a ease where coarse release agent particles ranging in size from 1.5 μm to 5 μm are present. Let's say a release agent dispersion liquid containing coarse release agent particles, a dispersion liquid of binding resin particles and a coloring agent dispersion liquid are mixed together and therein aggregation is induced. In such a case, the coarse release agent particles are not aggregated normally together with the binding resin particles and coloring agent particles, and there occurs formation of particles containing only the release agent component (namely, non-colored release agent particles) and having sizes close to the size of toner including binding resin particles, coloring agent particles and release agent particles. In addition, after manufacturing toner, the release agent particles that contain neither binding resin particles nor coloring agent particles, but have sizes close to the size of the toner cannot be separated from the toner that contains binding resin particles, coloring agent particles and release agent particles, because their sizes are equivalent or close to each other and non-colored release agent particles, the coarse release-agent particles, are present in the manufactured toner.

On the other hand, when the ratio of those non-colored release agent particles to the toner becomes high, the non-colored release agent particles, which are low in chargeability and resist being transferred as compared to usual tone particles, are apt to remain on a photoreceptor, the latent-image holding member. Therefore, when cleaning is carried out by pressing the front-end region of a cleaning blade as a cleaning member against the photoreceptor surface and allowing the cleaning blade to contact the photoreceptor surface, the non-colored release agent particles, which are softer than toner particles and external additive particles, adhere to and cumulate on the edge part of the cleaning blade under the pressure from the cleaning blade; as a result, cleaning capability of the cleaning blade deteriorates, and problems such as unevenness in image density and streaks tend to come up.

In every embodiment of the invention, therefore, mixing of release agent particles of the sort which are equivalent or close in size to toner particles and contain neither coloring agent nor binding resin (namely, non-colored release agent particles) in the finally-obtained toner is controlled by adopting a traditional dispersion liquid of release agent particles as the pre-dispersion liquid of release agent particles, separating release agent particles greater than 1.5 μm or about 1.5 μm in volume-average particle size from the pre-dispersion liquid of release agent particles, and then submitting the resulting dispersion liquid of release agent particles to an emulsion-polymerization-and-aggregation method.

Consequently, the rate of mixing of hard-to-charge non-colored release agent particles in the toner is lower than that in traditional toner, and more specifically, the amount of the non-colored release agent particles remaining on a photoreceptor, a latent-image holding member, is smaller than ever; as a result, adhesion of non-colored release agent particles to a cleaning blade as a cleaning member is reduced. Under the circumstances, even when development is carried out using the toner containing the non-colored release agent particles after production of pictorial output is performed over an extended period of time, occurrence of image defects including unevenness in image density and streaks can be reduced.

In every embodiment of the invention, the non-colored release agent particles of the sort which have a volume-average particle size from 0.8 to 1.2 times or about 0.8 to about 1.2 times the D50 value of the toner are included in a proportion of 50 or below, or about 50 or below per 5,000 of the toner particles, and thereby the rate of mixing of the hard-to-charge and hard-to-transfer non-colored release agent particles in the toner is lowered as compared to traditional toner, which means e.g. that the amount of the non-colored release agent particles remaining on a photoreceptor as a latent-image holding member is reduced. As a consequence, the adhesion of non-colored release agent particles to a cleaning blade as a cleaning member is controlled. The number of the non-colored release agent particles is preferably 30 or below, about 30 or below per 5,000 of the toner particles, and far preferably 10 or below, about 10 or below per 5,000 of the toner particles. As to the number of the non-colored release agent particles present in the toner, the lower the better, and the best number is zero. However, reduction in number of the non-colored release agent particles to zero in a fractionation process according to the sizes of release agent particles requires too long processing time. Therefore, such reduction is not so practical for reasons of productivity reduction and so on.

Additionally, the reason why the volume-average particle sizes of the non-colored release agent particles are defined as sizes from 0.8 to 1.2 times the D50 value of the toner consists in that, when the toner is prepared by an emulsion-polymerization-and-aggregation method, the particles having volume-average sizes smaller than eight-tenths of the D50 value of the toner form aggregates and decline in quantity, so they are hard to regard as becoming a problem; while the particles having volume-average sizes greater than 1.2 times the D50 value of the toner can be eliminated from a pre-dispersion liquid of release agent particles in a separation process, so they are also hard to regard as becoming a problem.

In every embodiment of the invention, the toner contains a release agent. Examples of a release agent containable in the toner include low-molecular-weight polyolefins such as polyethylene, polypropylene and polybutene, silicones whose softening temperatures are shown by heating, fatty acid amides such as oleic acid amide, erucic acid amide, ricinoleic acid amide and stearic acid amide, vegetable wax such as carnauba wax, rice wax, candelilla wax, Japan wax and jojoba oil, animal wax such as beeswax, mineral wax/petroleum wax such as montan wax, ozokerite, cerecin, paraffin wax, microcrystalline wax and Fischer-Tropsch wax, ester wax such as fatty acid esters, montanic acid esters and carboxylic acid esters, and their modification products. These release agents may be used alone or as combinations of two or more thereof.

As the release agent used in the toner according to each embodiment of the invention, a release agent low in compatibility with binding resins, notably a release agent low in polarity such as polyethylene or polypropylene, is suitable from the viewpoint of enhancing the unstickability of half-tone images containing the non-colored release agent particles, and in terms of the ability of toner to be easily unstuck from paper and resistance to developing unevenness in gloss, it is advantageous for the release agent to have weight-average molecular weight from 500 to 5,000 or from about 500 to about 5,000 and a melting temperature from 60° C. to 100° C. or from about 60° C. to about 100° C. As mentioned above, it is necessary for the release agent to instantly get in between a fixing member and images from inside the toner, so the release agents of the kinds recited above are suitable.

Various ingredients that constitute the toner according to each embodiment of the invention are illustrated below in detail.

Examples of a binding resin usable in the toner include homopolymers and copolymers obtained by polymerizing only one kind of monomer or two or more kinds of monomers chosen from styrenes such as styrene and chlorostyrene, monoolefins such as ethylene, propylene, butylenes and isoprene, vinyl esters such as vinyl acetate, vinyl propionate, vinyl benzoate and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, vinyl ketones such as vinyl methyl ketone, vinyl hexyl ketone and vinyl isopropenyl ketone, and the like. As particularly typical binding resins, mention can be made of polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene and the like. As additional examples, polyester, polyurethane, epoxy resin, silicone resin, polyamide, denatured rosin and paraffin wax can be cited. The weight-average molecular weights of those binding resins are preferably in a range of from 20,000 to 40,000, or from about 20,000 to about 40,000.

And typical examples of a coloring agent for use in the toner include magnetic powder such as magnetite or ferrite, carbon black, aniline blue, caryl blue, chrome yellow, ultramarine blue, Du Pont Oil Red, quinoline yellow, methylene blue chloride, phthalocyanine blue, Malachite Green oxalate, lampblack, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.1. Pigment Blue 15:3, and the like.

In addition, various ingredients such as an internal additive, a charge controlling agent, inorganic powder (inorganic particles) and organic particles can be added on an as needed basis. Examples of the internal additive include magnetic substances such as ferrite, magnetite, reduced iron, cobalt, nickel, manganese and like metals, alloys of these metals and compounds containing these metals. Examples of the charge controlling agent include quaternary ammonium salt compounds, Nigrosine compounds, dyes including metal complexes, such as an aluminum complex, an iron complex and a chromium complex, and triphenylmethane pigments. Inorganic power is added mainly for the purpose of controlling the viscoelasticity of toner, and examples thereof include all kinds of inorganic particles usually applied as external additives to the toner surface, such as alumina, titania, calcium carbonate, magnesium carbonate, calcium phosphate and cerium oxide, which are recited below in detail. Moreover, not only surfactants but also inorganic salts and salts of divalent or higher metals can be suitably used as aggregation agents. The use of metal salts in particular is favorable for aggregation ability control and such properties as toner-charging properties.

The volume-average particle size of the toner in every embodiment of the invention is from 2 μm to 8 μm or from about 2 μm to about 8 μm, preferably from 3 μm to 7 μm or from about 3 μm to about 7 μm, far preferably from 4 μm to 7 μm or from about 4 μm to about 7 μm. Too small particle sizes result in insufficiency of chargeability and cause reduction in developing ability, and thereby image density is apt to become low, while too large particle sizes bring about reduction in strength of non-colored release agent particles of the sort which have volume-average particle sizes from 0.8 to 1.2 times the D50 value of the toner, and colored streaks are apt to be made even when the non-colored release agent particles are few in number.

A method of manufacturing the toner according to every embodiment of the invention has a process of mixing a release agent and a dispersing agent to obtain a dispersion-liquid slurry, a process of heating the dispersion-liquid slurry to a temperature higher than the glass transition temperature of the release agent and emulsifying the heated slurry by discharge collision or discharge impact under high pressure to prepare a pre-dispersion liquid of release agent particles, and a process of separating release agent particles greater than 1.5 μm or about 1.5 μm in volume-average particle size from the pre-dispersion liquid of release agent particles, a process of mixing and aggregating a dispersion liquid of the separated release agent particles having 1.5 μm or below, or about 1.5 μm or below in volume-average particle size, a dispersion liquid of a coloring agent and a dispersion liquid of binding resin particles to obtain an aggregate, and a fusion-and-coalescence process of fusing and coalescing the obtained aggregate at a temperature higher than or equal to the glass transition temperature of the binding resin particles to obtain toner particles.

In the separation process, the prepared pre-dispersion liquid of release agent particles undergoes e.g. centrifugal separation using centrifugal separation apparatus, and thereby the release agent particles are separated into those having sizes of 1.5 μm or below and those having sizes greater than 1.5 μm. After the centrifugal separation, the supernatant liquor obtained, namely the dispersion liquid of the release agent particles having sizes of 1.5 μm or below, is extracted and submitted for use as the dispersion liquid of release agent particles in a later process step. The separation is performed through the application of a centrifugal force from 500 G to 1,000 G, though the centrifugal force is chosen as appropriate since conditions for the separation differ according to the kind and particle size distribution of the release agent used.

The manufacturing method includes the process of separating release agent particles greater than 1.5 μm in volume-average particle size from the pre-dispersion liquid of release agent particles, so it allows prevention of mixing of non-colored release agent particles, which are equivalent or close in size to toner particles and contain neither coloring agent nor binding resin, in the toner obtained finally.

<Electrostatic Image Developer>

The toner obtained in accordance with the method of manufacturing the present electrostatic latent-image developing toner as illustrated above is used as an electrostatic latent-image developer. This developer has no particular restrictions so long as it contains the present electrostatic latent-image developing toner, and can adopt an appropriate chemical composition in response to the intended purpose. When the electrostatic latent-image developing toner is used by itself, the developer is prepared as a one-component electrostatic latent-image developer; while, when the electrostatic latent-image developing toner is used in combination with a carrier, the developer is prepared as a two-component electrostatic latent-image developer.

The carrier has no particular restrictions, and is one which in itself is publicly known.

Examples of such a carrier include the following resin-coated carriers. Specifically, examples of a core particle of the carrier include commonly used iron powder, reconstituted ferrite, reconstituted magnetite and the like, and the average size of such a core particle is of the order of 30 μm to 200 μm. Examples of a resin with which the core particle is coated include copolymers of two or more kinds of monomers chosen from styrenes such as styrene, p-chlorostyrene and α-methylstyrene, α-methylene aliphatic monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, nitrogen-containing acrylates such as dimethylaminoethyl methacrylate, vinyl nitriles such as acrylonitrile and methacrylonitrile, vinylpyridines such 2-vinylpyridine and 4-vinylpyridine, vinyl ethers such as vinyl methyl ether and vinyl isobutyl ether, vinyl ketones such as vinyl methyl ketone, vinyl ethyl ketone and vinyl isopropenyl ketone, polyolefins such as ethylene and propylene, silicones such as methylsilicone and methylphenylsilicone, and fluorine-containing vinyl monomers such as vinylidene fluoride, tetrafluoroethnylene and hexafluoroethylene, polyesters containing bisphenol, glycol or the like, epoxy resin, polyurethane resin, polyamide resin, cellulose resin, and polyether resin. Of these resins, the resins obtained by polymerizing aromatic ring-containing polymerizable monomers are preferred over the others. This is because it is thought that the resins obtained by polymerizing aromatic ring-containing polymerizable monomers can easily hold static electricity in their aromatic rings at the time of electrostatic charging in conjunction with toner; as a result, even when the proportion of the non-colored release agent particles increases in the developer, generation of an excessive amount of electrostatic charge on the non-colored release agent particles can be controlled. The resins preferable by far are resins obtained by polymerization of polymerizable monomers including styrene whose aromatic ring part is likely to come into direct contact with toner. These resins may be used alone or as combinations of two or more thereof. The amount of resins coated is of the order of 0.1 part by weight to 10 parts by weight or about 0.1 part by weight to about 10 parts by weight with respect to the carrier, and the amount in a range of 0.5 part by weight to 3.0 parts by weight or about 0.5 part by weight to about 3.0 parts by weight is preferred. For manufacturing the carrier, a heat-applied kneader, a heat-applied Henschel mixer, a UM mixer and so on can be used, and depending on the amount of the resin coated, a heat-applied fluidized tumbling bed, a heat-applied kiln and the like can be used.

Additionally, the mixing ratio between the electrostatic latent-image developing toner and the carrier in the electrostatic latent-image developer has no particular limitations, and can be chosen as appropriate according to the intended purpose.

<Image Forming Apparatus>

Next, the image forming apparatus according to an exemplary embodiment of the invention is illustrated below.

FIG. 1 is a schematic diagram illustrating an example of the configuration of image forming apparatus for forming images by the method of image formation according to an exemplary embodiment of the invention. In the image forming apparatus 200 illustrated in FIG. 1, four electrophotographic photoreceptors 401*a* to 401*d* are juxtaposed to one another along an intermediate transfer belt 409 inside the housing 400. As to the electrophotographic photoreceptors 401*a* to 401*d*, it is possible to design the electrophotographic photoreceptor 401*a* to form e.g. yellow color images, the electrophotographic photoreceptor 401*b* to form e.g. magenta color images, the electrophotographic photoreceptor 401*c* to form e.g. cyan color images and the electrophotographic photoreceptor 401*d* to form e.g. black color images.

The electrophotographic photoreceptors 401*a* to 401*d* can be rotated in predetermined directions (in the paper-based counterclockwise direction), and along the directions of their respective rotations, charging rolls 402*a* to 402*d*, developing units 404*a* to 404*d*, primary transfer rolls 410*a* to 410*d* and cleaning blades 415*a* to 415*d* are disposed. Toner of four colors, namely black, yellow, magenta and cyan colors, contained in toner cartridges 405*a* to 405*d* can be fed into the developing units 404*a* to 404*d*, respectively, and the primary transfer rolls 410*a* to 410*d* are in tangential contact with the electrophotographic photoreceptors 401*a* to 401*d*, respectively, via the primary transfer belt 409.

Inside the housing 400, an exposure unit 403 is further placed in a predetermined position. The exposure unit 403 is configured so as to irradiate the charged surfaces of the electrophotographic photoreceptors 401*a* to 401*d* with light beams emitted therefrom. In this way, electrostatic charging, exposure, development, primary transfer and cleaning operations are each performed in sequence during the process of rotating the electrophotographic photoreceptors 401*a* to 401*d*, and toner images of different colors are transferred to the intermediate transfer belt 409 so that they are superposed on one another.

Herein, the charging rolls 402*a* to 402*d* are those which evenly apply voltage to the electrophotographic photoreceptors 401*a* to 401*d*, respectively, through contact between the surfaces of the photoreceptors and conductive members (charging rolls), whereby electrostatically charging the photoreceptor surfaces so that each photoreceptor surface has a predetermined electric potential (charging process). Incidentally, in place of the charging rolls adopted in the present embodiment, electrostatic charging may be performed by a contact charging method using charging brushes, charging film or charging tubes. Alternatively, electrostatic charging may be performed by a noncontact charging method using a corotron or a scorotron.

Those usable as the exposure unit 403 are e.g. optical units which enable the surfaces of the electrophotographic photoreceptors 401*a* to 401*d* to be exposed in desired image patterns to light from a light source such as semiconductor laser, LED (light emitting diode) or a liquid crystal shutter. Of such units, when exposure units of the type which enable incoherent-light exposure are used, interference fringes can be prevented from developing between the conductive substrate and the photoreceptive layer in each of the electrophotographic photoreceptors 401*a* to 401*d*.

Development can be performed by using as the developing units 404*a* to 404*d* general developing units carrying out development through contact or noncontact with the two-component electrostatic latent-image developers (developing process). Such developing units have no particular restrictions so long as they use two-component developers for electrostatic image development, and can be chosen from publicly known ones as appropriate according to the intended purposes. In the primary transfer process, toner of different colors undergo primary transfer in sequence from the image holding members to the intermediate transfer belt 409 by impressing primary transfer bias reverse in polarity to the toner held by the image holding members on the primary transfer rolls 410*a* to 410*d*.

The cleaning blades 415*a* to 415*d* are tools for elimination of residual toner adhering to the surfaces of the electrophotographic photoreceptors after the transfer process. The electrophotographic photoreceptors having surfaces cleaned with those blades are subjected to repeated uses. Examples of a material for the cleaning blades include urethane rubber, neoprene rubber, silicone rubber and the like.

The intermediate transfer belt 409 is supported under a predetermined tension by a driving roll 406, a backup roll 408 and a tension roll 407, and rotations of these rolls allow the belt to revolve without sagging. In addition, a secondary transfer roll 413 is placed so as to come into tangential contact with the backup roll 408 via the intermediate transfer belt 409.

By applying a secondary transfer bias, which is reverse in polarity to the toner on the intermediate transfer member, to the secondary transfer 413, the toner undergoes secondary transfer from the intermediate transfer belt to a recording medium. The intermediate transfer belt 409 having passed between the backup roll 408 and the secondary transfer roll 413 undergoes surface cleaning e.g. with a cleaning blade 416 placed in proximity to the driving roll 406 or a static eliminator (not shown in FIG. 1), and then subjected to a subsequent image forming process over and over again. Further, a tray (transfer receiving media tray) 411 is installed in a predetermined position inside the housing 400, and the transfer receiving media 500 such as paper sheets in the tray 411 are fed one after another and, by means of transporting rolls 412, transported between the intermediate transfer belt 409 and the secondary transfer roll 413, and further between two fixing rolls 414 which are in tangential contact with each other, and then ejected from the housing 400.

<Method of Image Formation>

A method of image formation according to an exemplary embodiment of the invention has at least a process of electrostatically charging an image holding member, a process of forming a latent image on the image holding member, a process of developing the latent image on the latent-image holding member with the electrophotographic developer, a primary transfer process of transferring the developed toner image to an intermediate transfer member, a secondary transfer process of transferring the toner image transferred to the intermediate transfer member to a recording medium, and a process of fixing the toner image by heat and pressure. The developer is a developer containing at least the present electrostatic image developing toner. And the developer may be either of one-component and two-component types.

To each of the foregoing processes, processes publicly known as to methods of image formation can be applied.

What can be used as the latent-image holding member is e.g. an electrophotographic photoreceptor or a dielectric recording material. In the case of an electrophotographic photoreceptor, the surface of the electrophotographic photoreceptor is uniformly charged with a corotron charger, a contact charger or the like, and then exposed to light, whereby an electrostatic latent image is formed (latent-image formation process). Next, toner particles are made to adhere to the electrostatic latent image by bringing a developing roll, at the surface of which a developer layer is formed, into contact with or proximity to the electrostatic latent image, whereby toner image is formed on the electrophotographic photoreceptor (development process). The toner image thus formed is transferred to the surface of a transfer-receiving material, such as paper, by use of a corotron charger or the like (transfer process). Further, the toner image transferred to the transfer-receiving material surface is thermally fixed with a fixing unit on an as needed basis, whereby the final toner image is formed.

Additionally, although a release agent is fed to a fixing member in an ordinary fixing unit for the purpose of preventing offset or the like when thermal fixing is carried out with the fixing unit, the fixing unit of an image forming apparatus according to an exemplary embodiment of the invention does not require feeding a release agent, and allows oil-less fixing.

There is no particular restriction as to the method of feeding a release agent to the surface of a roller or belt as a fixing member used in thermal fixing, but a pad method using a pad impregnated with a liquid release agent, a web method, a roller method, a non-contact shower method (a spray method) or the like can be adopted as the feeding method. Of these methods, a web method and a roller method are used to advantage. Using these methods is advantageous in that the release agent can be fed uniformly and it is easy to control the feed rate of a release agent. Incidentally, for feeding the release agent uniformly to the whole surface of the fixing member by use of a shower method, the use of an extra tool such as a blade is required.

Examples of a transfer-receiving material to which toner images are transferred (a recording material) include plain paper used in electrophotographic copiers and printers, and OHP sheets.

EXAMPLES

The invention is illustrated below in greater detail by reference to the following examples, but these examples should not be construed as limiting the scope of the invention.

In examples according to the invention, various measurements are made as follows.

Methods for Measuring Particle Size and Size Distribution of Particles

Measurements of a particle diameter (referred to as a particle size too) and a particle-diameter distribution (referred to as a particle-size distribution too) are described.

When the particle diameters to be measured are 2 μm or greater, the measuring apparatus used is Coulter Multisizer II (made by Beckman Coulter, Inc.), and the electrolytic solution used is ISOTON-II (made by Beckman Coulter, Inc.).

The measuring method adopted is as follows: A measuring sample in an amount of 0.5 mg to 50 mg is added to 2 ml of a 5% water solution of surfactant as a dispersing agent, preferably sodium alkylbenzenesulfonate, and further added to 100 ml of the electrolytic solution.

The electrolytic solution in which the measuring sample is suspended undergoes dispersion processing for about 1 minute by use of an ultrasonic dispersing machine, and the size distribution of particles ranging from 2 μm to 60 μm is measured with Coulter Multisizer II in which a 100-μm aperture is used as its aperture diameter, and thereby volume-average distribution and number-average distribution are determined. The number of particles measured therein is 50,000.

And the particle-size distribution of toner is determined by the following method. Volume accumulation distribution from the smaller particle size is plotted against the particle size ranges (channels) into which the measured particle-size distribution is divided. The cumulative-volume particle size corresponding to an accumulation of 16% is defined as D16v, and the cumulative-volume particle size corresponding to an accumulation of 50% as D50v. Further, the cumulative-volume particle size corresponding to an accumulation of 84% is defined as D84v.

The volume-average particle size in the invention is D50v, and the volume-average particle size index GSDv is calculated from the following expression.

Expression: $GSDv=\{(D84v)/(D16v)\}^{0.5}$

On the other hand, when the diameters of particles to be measured are smaller than 2 μm, measurements are made with a laser-diffraction particle-size distribution analyzer (Model LA-700, made by HORIBA, Ltd.). As to the measuring method, a sample is prepared in a state of dispersion liquid having a solid content of about 2 g, and thereto ion-exchanged water is added to make the total volume about 40 ml. This dispersion liquid is charged into a cell till an appropriate density is attained, and measurement is made when the concentration in the cell is almost stabilized by a wait of about 2 minutes. The thus obtained volume-average particle sizes for each of the channels are accumulated from the smaller volume-average particle size, and the point where the accumulation reaches 50% is taken as the volume-average particle size.

Additionally, in the case of measuring powder such as an external additive, a measuring sample is prepared by adding 2 g of a powder sample to 50 ml of a 5% water solution of surfactant, preferably sodium alkylbenzenesulfonate, and dispersing the mixture for 2 minutes by means of an ultrasonic dispersing machine (1,000 Hz), and subjected to measurement according to the same method as the foregoing dispersion liquid.

Method of Measuring Glass Transition Temperature

The glass transition temperature of toner is determined by DSC (Differential Scanning Calorimeter) measurement and evaluated from a main-constituent maximum peak as measured in accordance with ASTMD 3418-8.

For measurement of a main-constituent maximum peak, DSC-7 from Perkin Elmer, Inc. can be used. For temperature correction of the sensing section in this apparatus, the melting temperatures of indium and zinc are used, and the heat of indium fusion is used for correction of heat quantity. A pan made from aluminum is used for a sample, the pan empty of the sample is set as a reference, and the measurement is carried out at a temperature-rise rate of 10° C./min.

Measuring Method of Molecular Weight and Molecular-Weight Distribution of Toner's Resin Particles Molecular-weight distribution measurement is made under the following conditions. Apparatus HLC-8120 GPC, SC-8020 (made by TOSOH CORPORATION) is used for GPC, and two columns measuring 6.0 mm ID by 15 cm, TSK gel, Super HM-H (made by TOSOH CORPORATION) are used. And THF (tetrahydrofuran) is used as an eluant. Experiments are carried out using an IR detector under experimental conditions that the sample concentration is 0.5%, the flow velocity is 0.6 ml/min, the amount of a sample injected is 10 μl and the measurement temperature is 40° C. In addition, the calibration curve is made from polystyrene standard samples produced by TOSOH CORPORATION, TSK Standard: 10 samples of A-500, F-1, F-10, F-80, F-380, A-2500, F-4, F-40, F-128 and F-700.

Number of Non-Colored Release Agent Particles

The shooting of an observed image of toner in its entirety is done by use of EMAX Model 6923H (made by HORIBA, Ltd.), an energy-dispersive X-ray analyzer attached to a Hitachi-made electron microscope S4100, and about 5,000 particles arbitrarily picked out of the shot image are subjected to image analysis. More specifically, these particles are observed under a magnification of 800 times, and particles satisfying the conditions that they are non-colored particles and their particle sizes are from 0.8 to 1.2 times the D50 value of the toner particles, wherein the volume-average particle size of the toner is defined as D50, are searched for. Incidentally, as to the non-colored particles, elements contained in the particle surface are further analyzed with an energy-dispersive X-ray analyzer (EDX), and thereby the non-colored particles from the surfaces of which only carbon and hydrogen agents are detected are identified as non-colored release agent particles. In addition, the D50 value of the toner is given to one decimal place, and the particle sizes from 0,8 to 1.2 times this D50 value are also given to one decimal place by rounding off the numbers to the second decimal place.

Explanations of more specific comparative examples and examples in the invention are given below, but these examples should not be construed as limiting the substance of the invention in any way. Additionally, in the following explanations, all parts are by weight unless otherwise indicated.

<Example of Toner Manufacturing and Evaluation on Developer>

Preparation of Dispersion Liquid of Binding Resin Particles

Into a polymerization tank, 370 parts by weight of ion exchanged water and 0.3 parts by weight of a surfactant are changed, and the temperature thereof is raised up to 75° C. as they are mixed with stirring. On the other hand, the following ingredients are charged into an emulsification tank, and made into an emulsion by mixing with stirring.

| | |
|---|---|
| Ion exchanged water | 170 parts by weight |
| Nonionic surfactant (NONIPOLE 400, a product of Sanyo Chemical Industries, Ltd.) | 2 parts by weight |
| Anionic surfactant (NEOGEN SC, a product of Dai-ichi Kogyo Seiyaku Co., Ltd.) | 3 parts by weight |
| Styrene | 280 parts by weight |
| n-Butyl acrylate | 120 parts by weight |
| β-Carboxyethyl acrylate (hereinafter referred to as "β-CEA" too) | 11 parts by weight |
| Dodecanethiol | 6 parts by weight |
| 1,10-Decanediol diacrylate | 1.5 parts by weight |

At the time when the temperature of the polymerization tank is stabilized, a 2 wt % portion of the emulsion prepared is added to the reaction tank over 10 minutes, and then 5 parts by weight of ammonium persulfate in a state of being diluted with ion exchanged water by a factor of 5 is also added to the reaction tank over 10 minutes, and further held for 20 minutes as they are. Subsequently thereto, the remainder of the emulsion is added to the reaction tank over 3 hours. After the conclusion of the addition, the reaction mixture is held for additional 3 hours to complete the reaction. Thus, a dispersion liquid of binding resin particles is prepared. The resin obtained has a weight-average molecular weight of 35,000 and a volume-average particle size of 210 nm.

Preparation of Release Agent Dispersion Liquid (A)

| | |
|---|---|
| POLYWAX 655 (a hydrocarbon compound, a product of Baker Petrolite Corp.) | 30 parts by weight |
| Cationic surfactant (SANIZOL B50, a product of KAO Corporation) | 2 parts by weight |
| Ion exchanged water | 70 parts by weight |

These ingredients are heated up to 120° C., processed at 50 MPa by use of a high-pressure homogenizer and cooled down immediately, whereby a pre-dispersion liquid of release agent is obtained. The pre-dispersion liquid of release agent particles is centrifuged at 800 G for 10 minutes by centrifugal effect of centrifugal separation apparatus. Thereafter, supernatant liquor accounting for 50% by volume of the total supernatant liquor is extracted, and the supernatant liquor extracted, which contains release agent particles having sizes of 1.5 μm or below, is designated as a dispersion liquid (A) of release agent particles. The volume-average size of the release agent particles obtained is 205 nm. The hydrocarbon compound, POLYWAX 655, is polyethylene wax and has a number average molecular weight of 655 and a melting temperature of 99° C.

Preparation of Release Agent Dispersion Liquid (B)

A pre-dispersion liquid of release agent particles prepared using the same composition under the same conditions as in the preparation of the pre-dispersion liquid (A) of release agent particles is centrifuged at 800 G for 5 minutes by centrifugal effect of centrifugal separation apparatus. Thereafter, supernatant liquor accounting for 50% by volume of the total supernatant liquor is extracted, and the supernatant liquor extracted, which contains release agent particles having sizes of 1.5 μm or below, is designated as a dispersion liquid (B) of release agent particles. The volume-average size of the release agent particles obtained is 216 nm.

Preparation of Release Agent Dispersion Liquid (C)

A pre-dispersion liquid of release agent particles prepared using the same composition under the same conditions as in the preparation of the pre-dispersion liquid (A) of release agent particles is centrifuged at 800 G for 2 minutes by centrifugal effect of centrifugal separation apparatus. Thereafter, supernatant liquor accounting for 60% by volume of the total supernatant liquor is extracted, and the supernatant liquor extracted, which contains release agent particles having sizes of 1.5 μm or below, is designated as a dispersion liquid (C) of release agent particles. The volume-average size of the release agent particles obtained is 223 nm.

Preparation of Release Agent Dispersion Liquid (D)

A pre-dispersion liquid of release agent particles prepared using the same composition under the same conditions as in the preparation of the pre-dispersion liquid (A) of release agent particles is centrifuged at 500 G for 2 minutes by centrifugal effect of centrifugal separation apparatus. Thereafter, supernatant liquor accounting for 75% by volume of the total supernatant liquor is extracted, and the supernatant liquor extracted, which contains release agent particles having sizes of 1.5 μm or below, is designated as a dispersion liquid (D) of release agent particles. The volume-average size of the release agent particles obtained is 231 nm.

Preparation of Release Agent Dispersion Liquid (E)

A pre-dispersion liquid of release agent particles prepared using the same composition under the same conditions as in the preparation of the pre-dispersion liquid (A) of release agent particles is centrifuged at 800 G for 1 minute by centrifugal effect of centrifugal separation apparatus. Thereafter, supernatant liquor accounting for 80% by volume of the total supernatant liquor is extracted, and the supernatant liquor extracted, which contains release agent particles having sizes of 1.5 μm or below, is designated as a dispersion liquid (E) of release agent particles. The volume-average size of the release agent particles obtained is 237 nm.

Preparation of Release Agent Dispersion Liquid (F)

A pre-dispersion liquid of release agent particles prepared using the same composition under the same conditions as in the preparation of the pre-dispersion liquid (A) of release agent particles is centrifuged at 200 G for 2 minutes by centrifugal effect of centrifugal separation apparatus. Thereafter, supernatant liquor accounting for 80% by volume of the total supernatant liquor is extracted, and the supernatant liquor extracted, which contains release agent particles having sizes of 1.5 μm or below, is designated as a dispersion liquid (F) of release agent particles. The volume-average size of the release agent particles obtained is 242 nm.

Preparation of Release Agent Dispersion Liquid (G)

A pre-dispersion liquid of release agent particles prepared using the same composition under the same conditions as in the preparation of the pre-dispersion liquid (A) of release agent particles is centrifuged at 200 G for 1 minute by centrifugal effect of centrifugal separation apparatus. Thereafter, supernatant liquor accounting for 85% by volume of the total supernatant liquor is extracted, and the supernatant liquor extracted, which contains release agent particles having sizes of 1.5 μm or below, is designated as a dispersion liquid (G) of release agent particles. The volume-average size of the release agent particles obtained is 244 nm.

Preparation of Release Agent Dispersion Liquid (H)

A pre-dispersion liquid of release agent particles is prepared using the same composition under the same conditions as in the preparation of the pre-dispersion liquid (A) of release agent particles. Without undergoing any separation processing, this pre-dispersion liquid of release agent is designated as a dispersion liquid (H) of release agent particles. The volume-average size of the release agent particles obtained is 247 nm.

Preparation of Release Agent Dispersion Liquid (J)

| | |
|---|---|
| Carnauba wax (an ester compound, a product of TOA KASEI Co., Ltd.) | 30 parts by weight |
| Cationic surfactant (SANIZOL B50, a product of KAO Corporation) | 2 parts by weight |
| Ion exchanged water | 70 parts by weight |

These ingredients are heated up to 120° C., processed at 50 MPa by use of a high-pressure homogenizer and cooled down at once, whereby a pre-dispersion liquid of release agent is obtained. The pre-dispersion liquid of release agent particles is centrifuged at 800 G for 10 minutes by centrifugal effect of centrifugal separation apparatus. Thereafter, supernatant liquor accounting for 50% by volume of the total supernatant liquor is extracted, and the supernatant liquor extracted, which contains release agent particles having sizes of 1.5 μm or below, is designated as a dispersion liquid (J) of release agent particles. The volume-average size of the release agent particles obtained is 205 nm. The carnauba wax used is one which has a melting temperature of 80° C. to 86° C.

Preparation of Release Agent Dispersion Liquid (K)

| | |
|---|---|
| FT105 (a hydrocarbon compound, a product of NIPPON SEIRO Co., Ltd.) | 30 parts by weight |
| Cationic surfactant (SANIZOL B50, a product of KAO Corporation) | 2 parts by weight |
| Ion exchanged water | 70 parts by weight |

These ingredients are heated up to 120° C., processed at 50 MPa by use of a high-pressure homogenizer and cooled down at once, whereby a pre-dispersion liquid of release agent is obtained. The pre-dispersion liquid of release agent particles is centrifuged at 800 G for 10 minutes by centrifugal effect of centrifugal separation apparatus. Thereafter, supernatant liquor accounting for 50% by volume of the total supernatant liquor is extracted, and the supernatant liquor extracted, which contains release agent particles having sizes of 1.5 μm or below, is designated as a dispersion liquid (K) of release agent particles. The volume-average size of the release agent particles obtained is 205 nm. The FT105 used is a hydrocarbon compound having a melting temperature of 105° C.

(Preparation of Dispersion Liquid of Coloring Agent Particles)

Preparation of Cyan Coloring Agent Dispersion Liquid (1)

| | |
|---|---|
| C.I. Pigment Blue 15:3 (a product of Dainichiseika Color & Chemicals Mfg. Co., Ltd.) | 30 parts by weight |
| Ionic surfactant (NEOGEN RK, a product of DAI-ICHI KOGYO SEIYAKU Co., Ltd.) | 3 parts by weight |
| Ion exchanged water | 70 parts by weight |

These ingredients are mixed together and made to pass through an ultrasonic dispersing machine over 10 times, whereby a dispersion liquid (1) of cyan coloring agent particles is obtained. The number-average particle size of the dispersed pigment is 130 nm.

Preparation of Black Coloring Agent Dispersion Liquid (2)

| | |
|---|---|
| Carbon black (REGAL 330, a product of Cabot Corporation, primary particle size: 25 nm, BET specific surface area: 94 $m^2/g$) | 90 parts by weight |
| Anionic surfactant (NEOGEN SC, a product of DAI-ICHI KOGYO SEIYAKU Co., Ltd.) | 10 parts by weight |
| Ion exchanged water | 240 parts by weight |

A black coloring agent dispersion liquid (2) is prepared by mixing these ingredients together and dispersing them under the same condition as in the preparation of the cyan coloring agent dispersion liquid. The number-average particle size of the coloring agent in the black coloring agent dispersion liquid is 150 nm.

Preparation of Yellow Coloring Agent Dispersion Liquid (3)

| | |
|---|---|
| C.I. Pigment Yellow 74 (a product of Dainichiseika Color & Chemicals Mfg. Co., Ltd.) | 50 parts by weight |
| Ionic surfactant (NEOGEN RK, a product of DAI-ICHI KOGYO SEIYAKU Co., Ltd.) | 5 parts by weight |
| Ion exchanged water | 195 parts by weight |

These ingredients are mixed together and dispersed for 10 minutes by use of ULTIMIZER (made by Sugino Machine Limited), whereby a yellow coloring agent dispersion liquid (3) having a number-average particle size of 168 nm is prepared.

Preparation of Magenta Coloring Agent Dispersion Liquid (4)

| | |
|---|---|
| C.I. Pigment Red 122 (a product of Clariant Corporation) | 50 parts by weight |
| Ionic surfactant (NEOGEN RK, a product of DAI-ICHI KOGYO SEIYAKU Co., Ltd.) | 6 parts by weight |
| Ion exchanged water | 200 parts by weight |

These ingredients are mixed together and dispersed for 10 minutes by use of ULTIMIZER (made by Sugino Machine Limited), whereby a magenta coloring agent dispersion liquid (4) having a number-average particle size of 185 nm and a solid content of 23.5 parts by weight is prepared.

<Manufacturing of Toner 1a, Toner 1b, Toner 1c and Toner 1d>

The following ingredients are charged into a reaction tank and thoroughly mixed together with stirring.

| | |
|---|---|
| Ion exchanged water | 300 parts by weight |
| Dispersion liquid of binding resin particles | 159 parts by weight |
| Cyan coloring agent dispersion liquid (1) | 20 parts by weight |
| Release agent dispersion liquid (A) | 21 parts by weight |

Then, 15 parts by weight of a 1% water solution of polyaluminum chloride as a flocculant is added gradually as shear is applied to the resultant mixture by means of ULTRA TURRAX. Herein, a rise in viscosity of the slurry thus formed occurs as the amount of the flocculant added is increased, so the number of revolutions of ULTRA TURRAX is increased and dispersion processing is further carried out for 10 minutes after the conclusion of the addition.

When this slurry is given a gradual rise of temperature under thorough stirring and kept at 48° C. for 2 hours, the average size of aggregate particles becomes 5.1 μm. Thereto, the dispersion liquid of resin particles in an amount of 60 parts by weight is further added gradually over 5 minutes and allowed to stand for one hour, whereby the average size of aggregate particles reaches 5.5 μm. Then, coalescence of the aggregate particles is performed by adjusting the pH in the reaction tank to 7.0, giving a gradual temperature rise up to 95° C. and keeping that temperature for 3 hours. Thereafter, the matter obtained by the coalescence is cooled down to 40° C., cleaned and dried, whereby cyan toner 1a having an average particle size of 5.5 μm is obtained. The number of release agent particles ranging in size from 4.4 μm to 6.6 μm which are present per 5,000 toner particles in the toner 1a is found to be 7.

Black toner 1b, yellow toner 1c and magenta toner 1d are manufactured in the same manner as the cyan toner 1a is manufactured, except that the cyan coloring agent dispersion liquid (1) is replaced with the black coloring agent dispersion liquid (2), the yellow coloring agent dispersion liquid (3) and the magenta coloring agent dispersion liquid (4), respectively. The volume-average particle sizes of the toner 1b, the toner 1c and the toner 1d are each 5.5 μm as in the case of the cyan toner 1a. In addition, the numbers of release agent particles ranging in size from 4.4 μm to 6.6 μm which are present per 5,000 toner particles in each of the toner 1b, the toner 1c and the toner 1d are found to be 6, 4 and 7, respectively.

<Manufacturing of Toner 2>

Toner 2 is made in conformity with the case of manufacturing the toner 1a, except that the release agent dispersion liquid (B) is used in place of the release agent dispersion liquid (A). The average particle size of the toner obtained is 6.0 μm and the number of release agent particles ranging in size from 4.8 μm to 7.2 μm which are present per 5,000 toner particles is found to be 12.

<Manufacturing of Toner 3>

Toner 3 is made in conformity with the case of manufacturing the toner 1a, except that the release agent dispersion liquid (C) is used in place of the release agent dispersion liquid (A). The average particle size of the toner obtained is 4.6 μm and the number of release agent particles ranging in size from 3.7 μm to 5.5 μm which are present per 5,000 toner particles is found to be 18.

<Manufacturing of Toner 4>

Toner 4 is made in conformity with the case of manufacturing the toner 1a, except that the release agent dispersion liquid (D) is used in place of the release agent dispersion liquid (A). The average particle size of the toner obtained is 5.8 μm and the number of release agent particles ranging in size from 4.6 μm to 7.0 μm which are present per 5,000 toner particles is found to be 28.

<Manufacturing of Toner 5>

Toner 5 is made in conformity with the case of manufacturing the toner 1a, except that the release agent dispersion liquid (E) is used in place of the release agent dispersion liquid (A). The average particle size of the toner obtained is 5.6 μm and the number of release agent particles ranging in size from 4.5 μm to 6.7 μm which are present per 5,000 toner particles is found to be 33.

<Manufacturing of Toner 6>

Toner 6 is made in conformity with the case of manufacturing the toner 1a, except that the release agent dispersion liquid (F) is used in place of the release agent dispersion liquid (A). The average particle size of the toner obtained is 5.8 μm and the number of release agent particles ranging in size from 4.6 μm to 7.0 μm which are present per 5,000 toner particles is found to be 48.

<Manufacturing of Toner 7>

Toner 7 is made in conformity with the case of manufacturing the toner 1a, except that the release agent dispersion liquid (G) is used in place of the release agent dispersion liquid (A). The average particle size of the toner obtained is 6.0 μm and the number of release agent particles ranging in size from 4.8 μm to 7.2 μm which are present per 5,000 toner particles is found to be 54.

<Manufacturing of Toner 8>

Toner 8 is made in conformity with the case of manufacturing the toner 1a, except that the release agent dispersion liquid (H) is used in place of the release agent dispersion liquid (A). The average particle size of the toner obtained is 6.0 μm and the number of release agent particles ranging in size from 4.8 μm to 7.2 μm which are present per 5,000 toner particles is found to be 72.

<Manufacturing of Toner 9>

Toner 9 is made in conformity with the case of manufacturing the toner 1a, except that the release agent dispersion liquid (J) is used in place of the release agent dispersion liquid (A). The average particle size of the toner obtained is 6.4 μm and the number of release agent particles ranging in size from 5.1 μm to 7.7 μm which are present per 5,000 toner particles is found to be 11.

<Manufacturing of Toner 10>

Toner 10 is made in conformity with the case of manufacturing the toner 1a, except that the release agent dispersion liquid (K) is used in place of the release agent dispersion liquid (A). The average particle size of the toner obtained is 5.6 μm and the number of release agent particles ranging in size from 4.5 μm to 6.7 μm which are present per 5,000 toner particles is found to be 15.

<Manufacturing of Toner 11>

The inside temperature of a reaction tank is adjusted to 15° C., and the following ingredients are charged into the reaction tank and thoroughly mixed together with stirring.

| | |
|---|---|
| Ion exchanged water | 300 parts by weight |
| Dispersion liquid of binding resin particles | 159 parts by weight |
| Cyan coloring agent dispersion liquid (1) | 20 parts by weight |
| Release agent dispersion liquid (A) | 21 parts by weight |

Then, 30 parts by weight of a 2% water solution of aluminum chloride as a flocculant is added gradually as shear is applied to the resultant mixture by means of ULTRA TURRAX. After the conclusion of the addition, dispersion processing is further carried out for 10 minutes.

When the slurry thus made is given a gradual rise of temperature under thorough stirring and kept at 28° C. for 2 hours, the average size of aggregate particles becomes 1.6 μm. Thereto, the dispersion liquid of resin particles in an amount of 60 parts by weight is further added gradually over 5 minutes and allowed to stand for one hour. However, the average size of aggregate particles is still 1.6 μm. Then, coalescence of the aggregate particles is performed by adjusting the pH in the reaction tank to 7.0, giving a gradual temperature rise up to 95° C. and keeping that temperature for 3 hours. Thereafter, the matter obtained by the coalescence is cooled down to 40° C., cleaned and dried, whereby toner 11 having an average particle size of 1.8 μm is obtained. The number of release agent particles ranging in size from 1.4 μm to 2.2 μm which are present per 5,000 toner particles in the toner 11 is found to be 57.

<Manufacturing of Toner 12>

Toner 12 having an average particle size of 2.2 μm is obtained by the same manufacturing method as the toner 11 is obtained, except that the two-hour keeping at 28° C. is changed to two-hour keeping at 32° C. The number of release agent particles ranging in size from 1.8 μm to 2.6 μm which are present per 5,000 toner particles in this toner 12 is found to be 28.

<Manufacturing of Toner 13>

Toner 13 having an average particle size of 3.4 μm is obtained by the same manufacturing method as the toner 11 is obtained, except that the two-hour keeping at 28° C. is changed to two-hour keeping at 38° C. The number of release agent particles ranging in size from 2.7 μm to 4.1 μm which are present per 5,000 toner particles in this toner 13 is found to be 16.

<Manufacturing of Toner 14>

Toner 14 having an average particle size of 4.2 μm is obtained by the same manufacturing method as the toner 11 is obtained, except that the addition of 30 parts by weight of a 2% water solution of aluminum chloride is changed to addition of 15 parts by weight of a 1% water solution of polyaluminum chloride and the two-hour keeping at 28° C. is changed to two-hour keeping at 40° C. The number of release agent particles ranging in size from 3.4 μm to 5.0 μm which are present per 5,000 toner particles in this toner 14 is found to be 9.

<Manufacturing of Toner 15>

Toner 15 having an average particle size of 6.8 μm is obtained by the same manufacturing method as the toner 14 is obtained, except that the amount of the 1% water solution of polyaluminum chloride added is changed to 20 parts by weight from 15 parts by weight and the two-hour keeping at 40° C. is changed to three-hour keeping at 53° C. The number of release agent particles ranging in size from 5.4 μm to 8.2 μm which are present per 5,000 toner particles in this toner 15 is found to be 7.

<Manufacturing of Toner 16>

Toner 16 having an average particle size of 7.8 μm is obtained by the same manufacturing method as the toner 14 is obtained, except that the amount of the 1% water solution of polyaluminum chloride added is changed to 20 parts by weight from 15 parts by weight and the two-hour keeping at 40° C. is changed to three-hour keeping at 57° C. The number of release agent particles ranging in size from 6.2 μm to 9.4 μm which are present per 5,000 toner particles in this toner 16 is found to be 6.

<Manufacturing of Toner 17>

Toner 17 having an average particle size of 8.2 μm is obtained by the same manufacturing method as the toner 14 is obtained, except that the amount of the 1% water solution of polyaluminum chloride added is changed to 20 parts by weight from 15 parts by weight and the two-hour keeping at 40° C. is changed to three-hour keeping at 58° C. The number of release agent particles ranging in size from 6.6 μm to 9.8 μm which are present per 5,000 toner particles in this toner 17 is found to be 4.

Preparation of Developers 1a to 17

Electrostatic-image-developing toner is prepared by adding silica particles (R972, a product of Nippon Aerosil Co., Ltd.) as an external additive to each of the toner samples, the toner 1a to the toner 17, in the proportions of 100 parts by weight toner sample to 1.8 parts by weight silica, and then by mixing them by use of a Henschel Mixer. Subsequently, 8 parts by weight of the thus prepared electrostatic-image-developing toner is mixed with 100 parts by weight of carrier particles (average particle size: 35 μm) prepared by coating ferrite particles with polymethyl methacrylate resin (weight-average molecular weight: 80,000, produced by Soken Chemical & Engineering Co., Ltd.) in an amount of 1.5 wt % based on the ferrite particles. In this manner, two-component developers are prepared.

(Evaluation Method)

DocuCentre Color f450, a product of Fuji Xerox Co., Ltd., on which adaptations are made is used as a device for performing evaluations. The developer prepared as a developer sample by using each of the toner samples, the toner 1a to the toner 17, is put in a developing device and the process speed is adjusted to 210 mm/sec. Under these conditions, continuous running test of successive 10,000 sheets is carried out, and thereby evaluations are made. Specifically, production of output images is designed so that a solid image covering throughout all of the sheet surface in a toner-bearing quantity of 4 g/m$^2$ is output to the first sheet, and subsequently thereto 99 sheets of blank copies are made and the toner is supplied to the cleaning section once a 100-sheet continuous copying operation, and further the solid image is output again to the hundred first sheet. Image-density and streak evaluations are performed on the image output to the ten thousand first sheet.

<Image Density>

A difference between the image output to the ten thousand first sheet and the initial image is checked visually. Cases rated A to C on the following criteria are acceptable. Additionally, no image-density evaluation is made on cases where streaks as mentioned below develop to unacceptable degrees on the image output to the ten thousand first sheet.

A . . . No reduction in image density is observed.

B . . . Slight reduction in image density is observed, but it presents no problem in practical use.

C . . . Some reduction in image density is observed, but the degree thereof is within acceptable limits.

D . . . Conspicuous reduction in image density is observed, and the degree thereof is exceeding acceptable limits.

Streak Evaluation

A blank image output to the ten thousandth sheet and a solid image output to the ten thousand first sheet are checked visually for streaks on the images and those on the photoreceptor and evaluated on the following criteria. Additionally, cases rated A to C are regarded as acceptable.

A . . . No streak is observed.

B . . . Streaks are observed on the photoreceptor, but no streak develops on the images.

C . . . A few streaks are observed on the blank image or the solid image, but they present no problem in practical use.

D . . . Streaks are observed distinctly on the blank image or the solid image.

TABLE 1

| | | Dispersion | Toner Particle size | | | | | |
|---|---|---|---|---|---|---|---|---|
| | Toner | liquid of release agent particles | Central value (μm) | multiplied by 0.8 (μm) | multiplied by 1.2 (μm) | Number of release agent particles *1 | Image density | streaks |
| Example 1 | 1a | A | 5.5 | 4.4 | 6.6 | 7 | A | A |
| Example 2 | 1b | A | 5.5 | 4.4 | 6.6 | 6 | A | A |
| Example 3 | 1c | A | 5.5 | 4.4 | 6.6 | 4 | A | A |
| Example 4 | 1d | A | 5.5 | 4.4 | 6.6 | 7 | A | A |
| Example 5 | 2 | B | 6 | 4.8 | 7.2 | 12 | A | B |
| Example 6 | 3 | C | 4.6 | 3.7 | 5.5 | 18 | A | B |
| Example 7 | 4 | D | 5.8 | 4.6 | 7.0 | 28 | B | B |
| Example 8 | 5 | E | 5.6 | 4.5 | 6.7 | 33 | B | C |
| Example 9 | 6 | F | 5.8 | 4.6 | 7.0 | 48 | C | C |
| Example 10 | 9 | J | 6.4 | 5.1 | 7.7 | 11 | B | A |
| Example 11 | 10 | K | 5.6 | 4.5 | 6.7 | 15 | B | A |
| Example 12 | 12 | A | 2.2 | 1.8 | 2.6 | 28 | C | C |
| Example 13 | 13 | A | 3.4 | 2.7 | 4.1 | 16 | B | B |
| Example 14 | 14 | A | 4.2 | 3.4 | 5.0 | 9 | A | A |
| Example 15 | 15 | A | 6.8 | 5.4 | 8.2 | 7 | A | A |
| Example 16 | 16 | A | 7.8 | 6.2 | 9.4 | 6 | B | C |
| Comparative Example 1 | 7 | G | 6 | 4.8 | 7.2 | 54 | D | C |
| Comparative Example 2 | 8 | H | 6 | 4.8 | 7.2 | 72 | — | D |
| Comparative Example 3 | 11 | A | 1.8 | 1.4 | 2.2 | 57 | — | D |
| Comparative Example 4 | 17 | A | 8.2 | 6.6 | 9.8 | 4 | — | D |

Note

*1 Number of non-colored release agent particles ranging in volume-average particle size from 0.8 to 1.2 times the D50 value of each toner per 5,000 of the toner particles.

Good uses of the invention include application to image forming apparatus, such as electrophotography-utilized copiers and printers.

What is claimed is:

1. An electrostatic image developing toner comprising:

toner particles that contain a binding resin, a coloring agent and a release agent and that have D50 of from about 3.4 μm to about 6.8 μm, D50 standing for a volume-average particle size of the toner particles; and non-colored release agent particles, wherein out of the non-colored release agent particles, those ranging in volume-average particle size of from about 0.8 to about 1.2 times a value of D50 are present in a proportion from 4 to 50 per 5,000 of the toner particles.

2. The electrostatic image developing toner as claimed in claim 1, wherein the release agent has a weight-average molecular weight of from about 500 to about 5,000.

3. The electrostatic image developing toner as claimed in claim 1, wherein the release agent has a melting temperature of from about 60° C. to about 100° C.

4. The electrostatic image developing toner as claimed in claim 1, wherein the release agent is a hydrocarbon compound.

5. The electrostatic image developing toner as claimed in claim 1, wherein the coloring agent is C.I. Pigment Yellow 74.

6. The electrostatic image developing toner as claimed in claim 1, wherein the coloring agent is C.I. Pigment Red 122.

7. The electrostatic image developing toner as claimed in claim 1, wherein the coloring agent is C.I. Pigment Blue 15:3.

8. The electrostatic image developing toner as claimed in claim 1, wherein the binding resin has a weight-average molecular weight of from about 20,000 to about 40,000.

9. An electrostatic image developer comprising:

the electrostatic image developing toner as claimed in claim 1; and a carrier.

10. The electrostatic image developer as claimed in claim 9, wherein the carrier is coated with a coating resin.

11. The electrostatic image developer as claimed in claim 10, wherein the coating resin is from about 0.1 part by weight to about 10 parts by weight in quantity based on the carrier.

12. The electrostatic image developing toner as claimed in claim 1, toner particles that contain a binding resin, a coloring agent and a release agent and that have D50 of from about 4.2 μm to about 6.8 μm, wherein:

the release agent has a weight-average molecular weight of from about 500 to about 5,000.

13. A method of image formation, comprising:

electrostatically charging a photoreceptor;

exposing the electrostatically-charged photoreceptor to form a latent image on the photoreceptor;

developing the latent image to form a developed image;

transferring the developed image to a transfer-receiving material; and fixing a toner on a fixing substrate by heating, wherein the toner is the electrostatic image developing toner as claimed in claim 1.

* * * * *